US008096256B2

(12) United States Patent
Mackie

(10) Patent No.: US 8,096,256 B2
(45) Date of Patent: Jan. 17, 2012

(54) PASSIVELY-ACTUATED LANYARD CLAMP

(75) Inventor: Kevin J. Mackie, Mansfield, MA (US)

(73) Assignee: Lockheed Martin Corporation, Bethesda, MD (US)

( * ) Notice: Subject to any disclaimer, the term of this patent is extended or adjusted under 35 U.S.C. 154(b) by 972 days.

(21) Appl. No.: 11/467,179

(22) Filed: Aug. 25, 2006

(65) Prior Publication Data

US 2008/0121748 A1 May 29, 2008

(51) Int. Cl.

| | |
|---|---|
| ***B63B 21/24*** | (2006.01) |
| ***B63B 21/29*** | (2006.01) |
| ***B63B 21/46*** | (2006.01) |
| *B63B 22/04* | (2006.01) |
| *B63B 22/08* | (2006.01) |
| *B63B 22/18* | (2006.01) |

(52) U.S. Cl. ..... 114/294; 441/6; 441/21; 441/25; 441/26

(58) Field of Classification Search ..... 441/6–29; 114/199, 200, 293, 294, 210; 188/65.1–65.5; 102/390–392, 411–414; 242/287, 381.1, 381.2; 254/391; 33/719, 720; 367/2–6; 43/3

See application file for complete search history.

(56) References Cited

U.S. PATENT DOCUMENTS

| | | | | |
|---|---|---|---|---|
| 2,722,018 | A * | 11/1955 | Mueller | 441/25 |
| 3,772,639 | A * | 11/1973 | Snyder | 367/4 |
| 4,068,608 | A | 1/1978 | Hartz | |
| 4,246,671 | A * | 1/1981 | Swenson | 441/25 |
| 4,572,565 | A | 2/1986 | Epstein | |
| 5,782,663 | A * | 7/1998 | Van Raden | 441/25 |

* cited by examiner

*Primary Examiner* — Ajay Vasudeva
(74) *Attorney, Agent, or Firm* — DeMont & Breyer, LLC

(57) ABSTRACT

A passively-actuated lanyard clamp is disclosed that provides an improved ability to deploy a terminal weight or anchor in a body of water without some of the disadvantages for doing so in the prior art. An embodiment of the present invention comprises a mechanically-bistable latch for clamping a lanyard, wherein the latch is passively-actuated by a force that develops as a result of the terminal weight reaching the bottom of the body of water.

15 Claims, 5 Drawing Sheets

PASSIVELY-ACTUATED LANYARD CLAMP

STATEMENT REGARDING FEDERALLY-SPONSORED RESEARCH

This invention was made with Government support under N00014-02-C-0211 awarded by Office of Naval Research. The Government has certain rights in the invention.

FIELD OF THE INVENTION

The present invention relates to winding devices in general, and, more particularly, to winding device clamps.

BACKGROUND OF THE INVENTION

Navigation aids, channel markers, water-based mines, and the like, are floating objects (on the water surface or below) that are typically anchored to the bottom of a body of water in order to hold them at a fixed coordinate. Typically, such an object is attached, by means of a lanyard, to a submerged weight that resides on the bottom of the body of water. The lanyard provides a positive connection between the floating objects and the bottom of a body of water. For the purposes of this specification, including the appended claims, the term "lanyard" means a cord, a chain, a rope, a cable, or the like, which can be used to connect one object to another.

In addition, communication cables, and the like, are often deployed along the bottom of a body of water, such as an ocean, and require positive connection to the bottom at various points.

There are several methods to deploy a floating object or communications cable. A first deployment method requires that a weight is attached to a lanyard on board a ship floating on the surface of the water. The weight, with attached lanyard, is then allowed to fall through the water until it reaches the bottom. As the weight falls, the lanyard pays out from a capstan located on board the ship. During lanyard payout, an axial tension develops in the lanyard. The weight's arrival at the bottom is indicated by a decrease in this axial tension. Once the weight is determined to be on the bottom, the lanyard is clamped to preclude further lanyard payout. The floating object is then attached to the lanyard, the lanyard is cut above this attachment point, and the floating object is jettisoned overboard.

There are several drawbacks to this first method, however. First, it is a time-consuming and labor-intensive process. Second, fluctuation of underwater currents can lead to false indications that the weight has reached the bottom. Third, the process can be dangerous due to the forces that can develop when a lanyard under high axial tension is cut.

A second method for deploying a floating object utilizes a lanyard clamp that is submerged with the weight. A control line is attached to this lanyard clamp so that it can be actively actuated once it is determined that the weight has reached the bottom. In addition to having many of the same drawbacks of the first method, this method also adds cost and complexity due to the additional lanyard and lanyard handling apparatus. In addition, the added infrastructure exacerbates deck crowding on the ship, which exposes on-board personnel to additional safety hazard. Finally, fluctuation of underwater currents can cause snarling of the multiple lanyards during deployment.

There exists a need, therefore, for a weight deployment system that avoids or mitigates some or all of these problems.

SUMMARY OF THE INVENTION

The present invention provides a system for deploying a terminal weight or anchor in a body of water that avoids some of the costs and disadvantages for doing so in the prior art. In particular, the illustrative embodiment of the present invention uses a weight having a passively-actuated latch to clamp a lanyard, thereby fixing the attachment point of the lanyard to the weight.

In the prior art, the length of a lanyard that connects a sunken weight to an object above, such as a float, buoy, ship, and the like, is fixed by actively clamping the lanyard once it is determined it has sunk completely. This requires maintaining contact with the weight as it sinks, sensing when the weight has reached the bottom of the body of water, and actively engaging a clamping mechanism to connect the sunken weight to the object.

In contrast to the prior art, the present invention provides a weight having an integrated latch for clamping a lanyard, wherein the latch is passively-actuated by a force generated in response to the arrival of the weight at the bottom. As a result, the object and the attached weight can be deployed without active participation of an operator after they are placed in the water.

In some embodiments, the system comprises a float and a weight having an integral lanyard spool, rotator, and latch. The weight and float are connected via a lanyard that is spooled onto the lanyard spool, and which can provide a positive connection between the float and the bottom of the body of water, such as an ocean bottom. During deployment of the float, the weight is allowed to payout lanyard while it falls through the body of water until the weight rests on the bottom. Once on the bottom, the weight rotates due to the rotator and a bending moment is generated in the lanyard. The bending moment causes the actuation of the latch, which clamps onto the lanyard and prevents further lanyard payout.

The illustrative embodiment comprises: a weight for anchoring a lanyard; and a guide for guiding the lanyard during deployment of the weight, wherein the guide comprises a latch for clamping the lanyard when the weight is fully-deployed, and wherein the latch is passively-actuated when the weight is fully-deployed.

DETAILED DESCRIPTION

Figure 1:
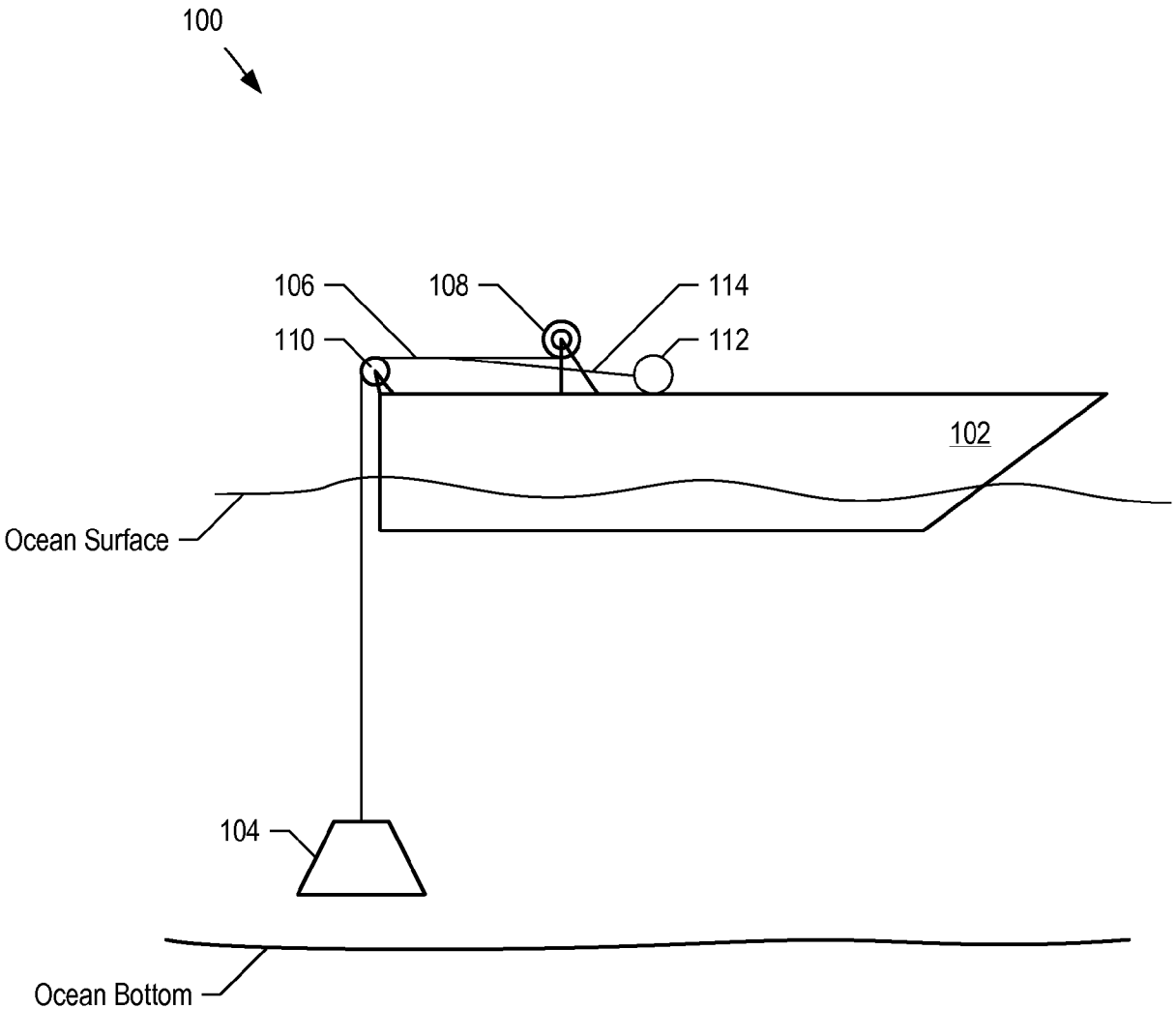
Figure 1 (Prior Art)
FIG. 1 depicts details of a ship deploying a float in accordance with the prior art.

FIG. 1 depicts details of a ship deploying a float in accordance with the prior art. Float-deployment system 100 comprises weight 104, lanyard 106, capstan 108, bearing 110, float 112, and line 114.

Ship 102 carries float-deployment system 100 to a desired float deployment site. During float deployment, weight 104, attached to lanyard 106, is allowed to fall through the water toward the ocean bottom. Capstan 108 controls the speed of the weight's descent by maintaining an axial tension on lanyard 106 as necessary. When weight 104 reaches the ocean bottom, capstan 108 senses a decrease in the axial tension in lanyard 106 and halts its payout.

Once weight 104 reaches the ocean floor, float 112 is attached to lanyard 106 via line 114. Finally, lanyard 106 detached above its junction to line 114 and float 112 is jettisoned overboard.

Figure 2:
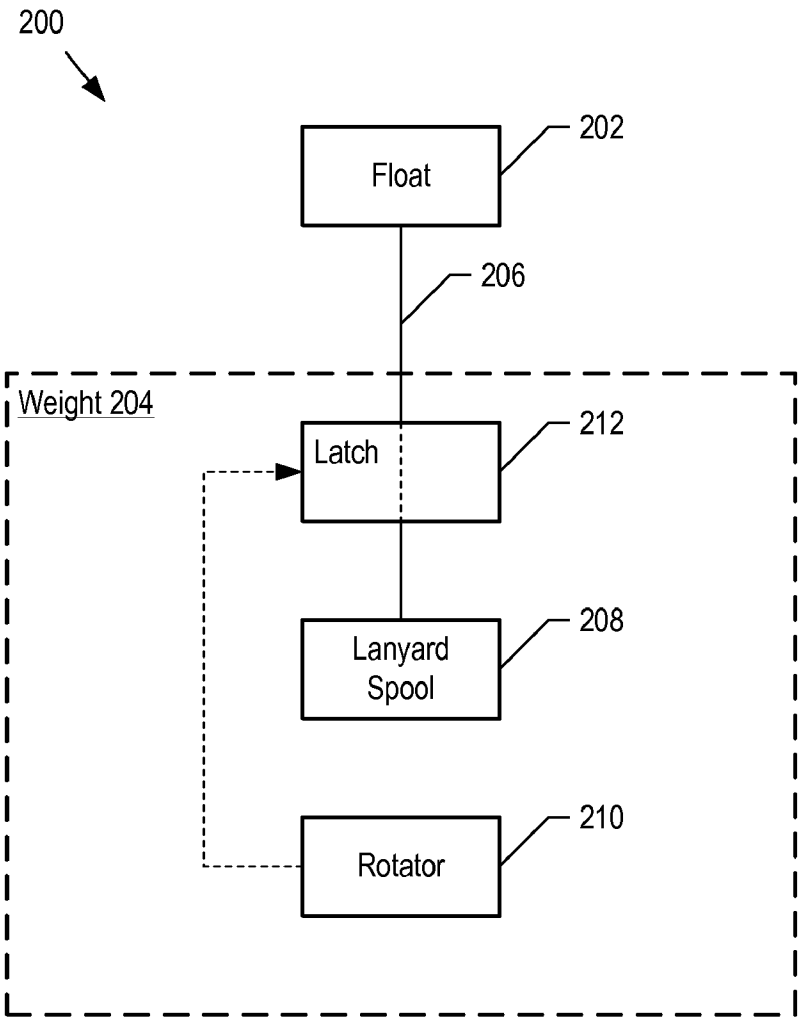
FIG. 2 depicts a schematic diagram of details of a float deployment system in accordance with an illustrative embodiment of the present invention.

FIG. 2 depicts a schematic diagram of details of a float deployment system in accordance with an illustrative embodiment of the present invention. Float system 200 comprises float 202, weight 204, and lanyard 206.

Float 202 is a buoyant hollow sphere, designed to float at or near the surface of a body of water, such as an ocean. In some alternative embodiments, float 202 is a non-spherical buoyant device or platform. In some alternative embodiments, float 202 is a buoyant hollow sphere or other buoyant device or platform designed to float below the surface of the water to anchor a submerged device, such as an explosive mine, acoustic source, sensor, and the like. It will be clear to those skilled in the art, after reading this specification, how to make and use float 202.

Weight 204 is a non-buoyant object made of non-corrosive material. Weight 204 is designed to sink to the ocean bottom and remain substantially fixed in place once in contact with the ocean floor. In some alternative embodiments, weight 204 is made of a corrosive material, but whose rate of corrosion is slow enough to ensure sufficient lifetime of float system 200.

Lanyard 206 is a metal lanyard of sufficient strength as to provide a positive connection between weight 204 and float 202. In some alternative embodiments, lanyard 206 comprises non-metallic materials. It will be clear to those skilled in the art, after reading this specification, how to make and use lanyard 206.

Weight 204 comprises lanyard spool 208, rotator 210, and latch 212.

Lanyard spool 208 is a spool for carrying and paying out lanyard 206. Lanyard spool is rotatable with respect to weight 204. The rotatable nature of lanyard spool 208 enables lanyard 206 to be paid out during deployment of float 202 without a need for weight 204 to rotate. In some alternative embodiments, lanyard spool is not rotatable with respect to weight 204. It will be clear to those skilled in the art, after reading this specification, how to make and use lanyard spool 208.

Rotator 210 is a curved feature located on the bottom end of weight 204. Rotator 210 causes a rotation of weight 204 upon contact with the ocean bottom. This rotation causes a bending moment to arise in lanyard 206, as will be discussed below and with respect to FIG. 5.

Latch 212 is a passively-actuated latch for controlling the payout of lanyard 206 from lanyard spool 208. Latch 212 is a mechanically-bistable latch that has two stable mechanical positions. In its first position, latch 212 guides lanyard 206 and allows its payout. In its second position, latch 212 clamps lanyard 206 and disallows its payout.

As weight 204 sinks through the water, but prior to it reaching the ocean bottom, it creates an axial tension in lanyard 206. This axial tension serves to keep latch 212 its first mechanically-stable position. Once weight 204 reaches the ocean bottom, however, the axial tension is reduced or eliminated. In addition, rotator 210 causes weight 204 to rotate after contacting the ocean floor. This rotation induces a side-load (i.e., a bending moment) in lanyard 206, which causes latch 212 to actuate. As a result, latch 212 actuates passively from its first mechanically-stable position to its second mechanically-stable position. Latch 212 is described in more detail below and with respect to FIGS. 4 and 5.

Figure 3B:
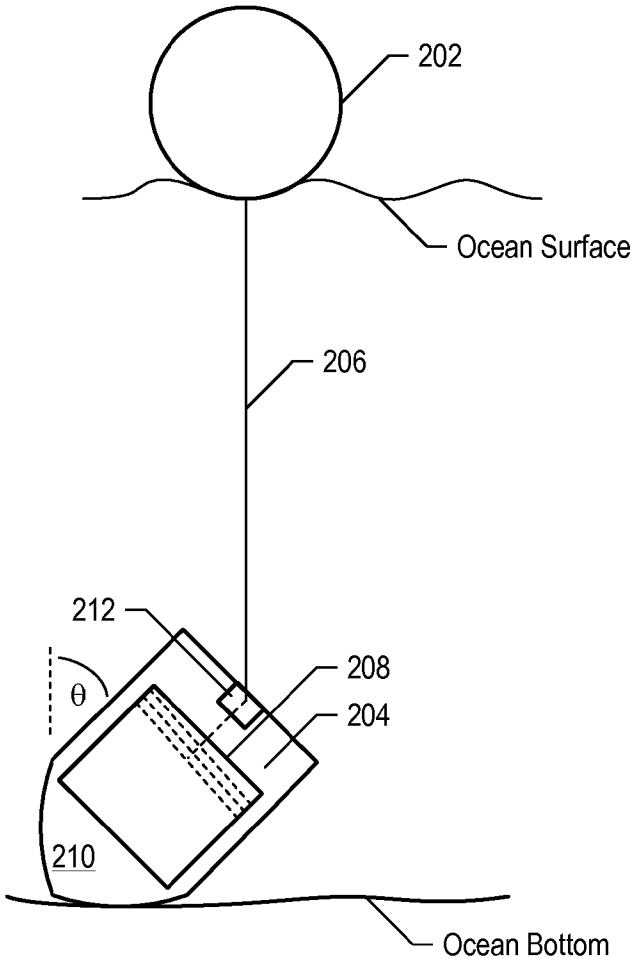
FIG. 3B depicts details of float deployment system 200, after deployment, in accordance with the illustrative embodiment of the present invention.
Figure 3A:
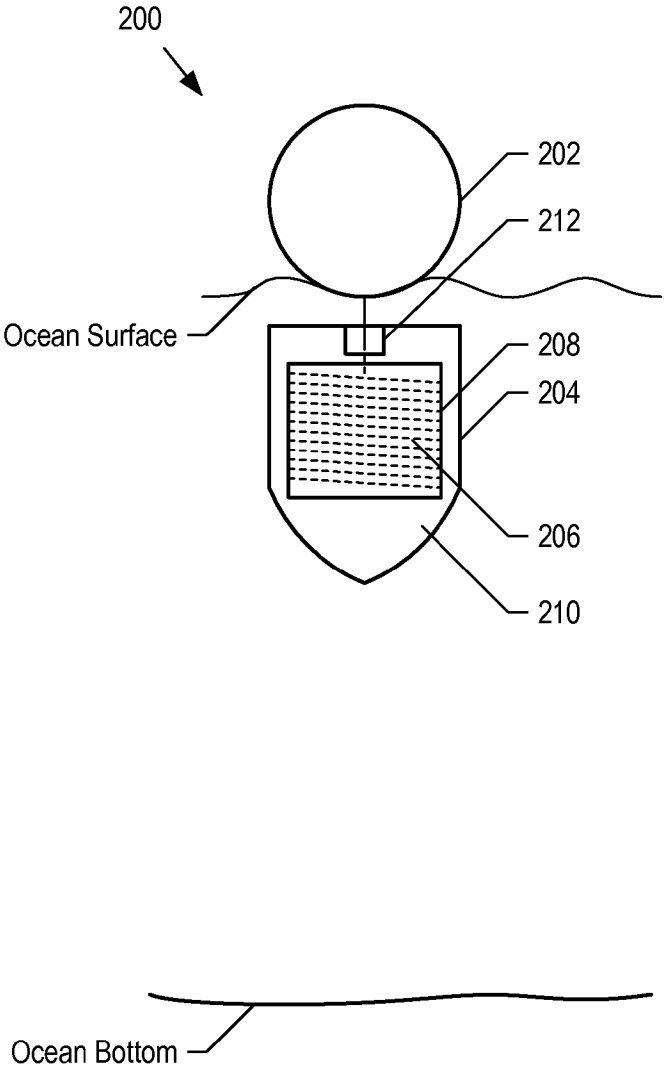
FIG. 3A depicts details of float deployment system 200, prior to deployment, in accordance with the illustrative embodiment of the present invention.

FIG. 3A depicts details of float deployment system 200, prior to deployment, in accordance with the illustrative embodiment of the present invention. Weight 204 is depicted hanging from float 202, which is floating on the ocean surface. Lanyard spool 208 holds nearly the entire length of lanyard 206 at the beginning of float deployment. A portion of lanyard 206 is threaded through latch 212 and fastened to float 202 to provide interconnection of float 202 and weight 204.

FIG. 3B depicts details of float deployment system 200, after deployment, in accordance with the illustrative embodiment of the present invention. Weight 204 is depicted after it has sunk to the ocean bottom and rotated into its final rest position. Weight 204 rests at an angle, $\theta$, which is dependent upon the relation between rotator 210 and the local slope of the ocean floor on which weight 204 rests. The bending moment induced in lanyard 206 is a function of $\theta$ and the weight of weight 204. Weight 204, rotator 210, and latch 212 are designed such that the bending moment is sufficient to passively-actuate latch 212. Upon actuation of latch 212, the length of lanyard 206 between weight 204 and float 202 is fixed and a positive connection between float 202 and the ocean bottom is established.

Although the illustrative embodiment depicts rotator 210 as a rounded element, it will be to those skilled in the art, after reading this specification, how to make and use alternative embodiments of the present invention wherein rotator 210 comprises any shape sufficient to induce a suitable rotation of weight 204.

Figure 4:
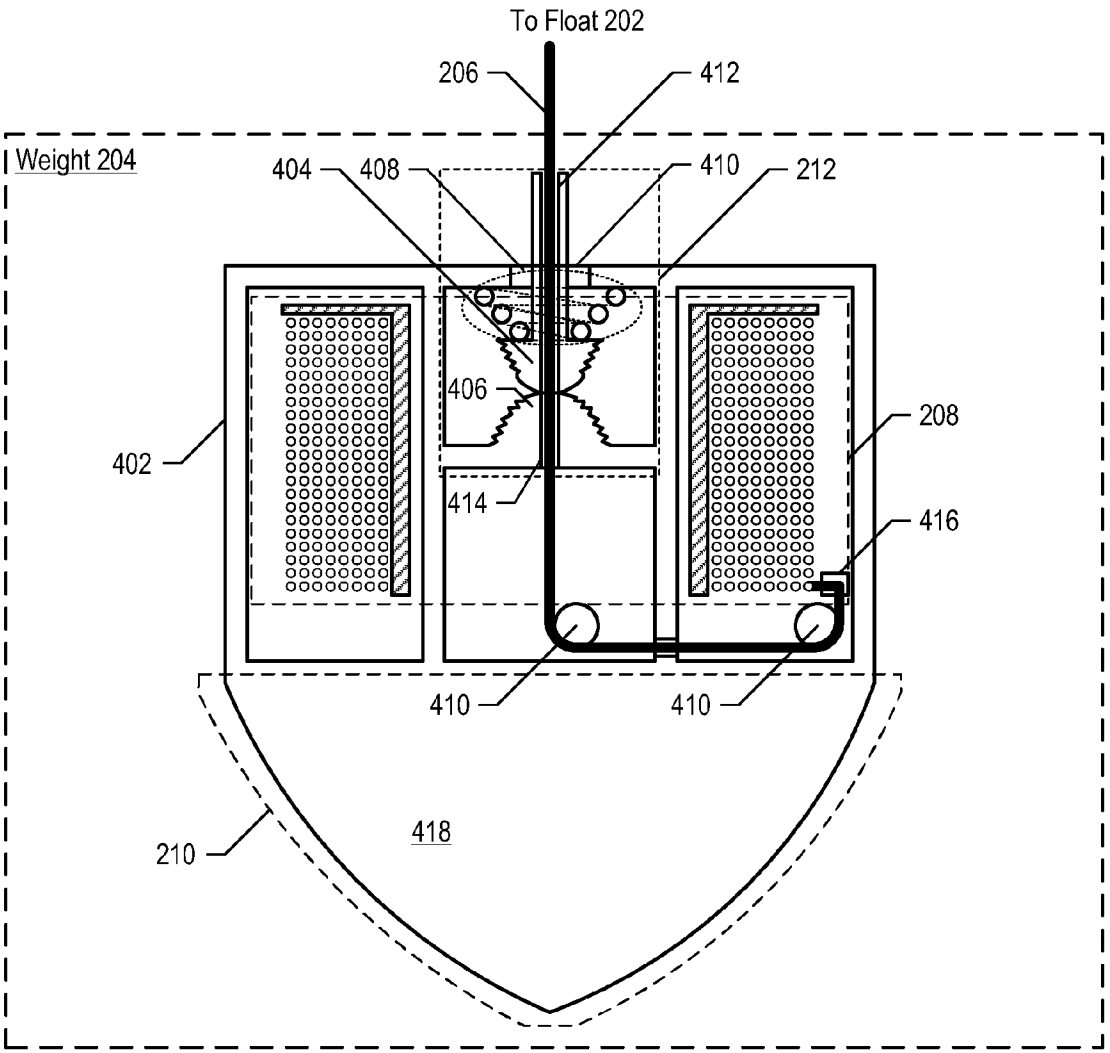
FIG. 4 depicts details of weight 204, prior to deployment, in accordance with the illustrative embodiment of the invention.

FIG. 4 depicts details of weight 204, prior to deployment, in accordance with the illustrative embodiment of the invention. Weight 204 comprises housing 402, first guide 404, second guide 406, spring 408, and bearings 410.

Housing 402 is a corrosive-resistant metallic canister that houses lanyard 206 on lanyard spool 208, and latch 212. Housing 402 also comprises a solid region 418, which both provides mass and is shaped to function as rotator 210.

Lanyard spool 208 is a cylindrical spool for holding lanyard 206 in well-known fashion. Lanyard spool 208 is attached to housing 402 via bearings (not shown for clarity) that enable lanyard spool 208 to rotate with respect to housing 402. Rotation of lanyard spool 208 occurs as lanyard 206 unwinds and pays out during deployment of weight 204. Lanyard spool 208 also incorporates traveler 416, which travels along lanyard spool 208 to guide the winding and unwinding of lanyard 206 on lanyard spool 208. Traveler 416 also keeps the windings of lanyard 206 wound in orderly fashion on lanyard spool 208, regardless of the orientation of weight 204.

Although the illustrative embodiment comprises a lanyard spool that includes a traveler, it will be clear to those skilled in the art, after reading this specification, how to make and use alternative embodiments of the present invention wherein lanyard spool 208 does not incorporate a traveler. In some alternative embodiments, cable spool 208 comprises a flange having a rounded edge for guiding cable 206 during cable payout.

First guide 404, second guide 406, and spring 408 together compose latch 212. FIG. 4 depicts latch 212 in its first mechanically-stable position, wherein lanyard 206 is allowed to pass through first guide 404 and second guide 406 during lanyard payout. When latch 212 is in its first mechanically-stable position, first guide 404 and second guide 406 are aligned such that their respective through-holes are substantially coaxial and thereby form a substantially continuous single sleeve for guiding lanyard 206.

First guide 404 is a cylindrical metallic tube with a protuberance at one end. The outer surface of the protuberance has serrations to enhance its surface roughness and thereby improve its clamping capability. In some alternative embodiments, the surface of the protuberance is not structured. In some alternative embodiments, the surface of the protuberance is structured without serrations. First guide 404 forms a first sleeve for guiding lanyard 206 by virtue of through-hole 412. The diameter of through-hole 412 is just slightly larger than the diameter of lanyard 206. In some alternative embodiments, through-hole 412 comprises a material or sleeve of material, such as Teflon, plastic, ceramic, and the like, to facilitate the passage of cable 206.

Second guide 406 is formed as an integral part of housing 402. Like first guide 404, second guide 406 comprises a protuberance having serrations to enhance its surface roughness. Second guide 406 forms a second sleeve for guiding lanyard 206 by virtue of through-hole 414. The diameter of through-hole 414 is just slightly larger than the diameter of lanyard 206.

In some alternative embodiments of the present invention, at least one of first guide 404 and second guide 406 comprise a material other than metal. Suitable materials for use in first guide 404 and second guide 406 include, without limitation, metals, graphite, plastics, ceramics, Kevlar, and polycarbonate materials. In some alternative embodiments, through-hole 414 comprises a material or sleeve of material, such as Teflon, plastic, ceramic, and the like, to facilitate the passage of cable 206.

Spring 408 is a metallic spring for actuating latch 212. When latch 212 is actuated, it moves to its second mechanically-stable position, as depicted below and with respect to FIG. 5. Spring 408 provides sufficient force to actuate latch 212 and hold first guide 404 in its actuated position, such that the actuation of latch 212 is irreversible. For the purposes of this specification, including the appended claims, the term "irreversible" means that latch 212 can not be returned to its first mechanically-stable position without directly resetting latch 212. In order to reset latch 212, some disassembly of weight 204 is typically required.

Bearings 410 are roller bearings for guiding lanyard 206 from traveler 416 to second guide 406. In some alternative embodiments of the present invention, bearings 410 are not required. Although the illustrative embodiment comprises bearings 410 that are roller bearings, it will be clear to those skilled in the art, after reading this specification, how to make and use alternative embodiments of the present invention wherein bearings 410 comprise bearings of other types. It will be clear to those skilled in the art how to make and use bearings 410.

Figure 5:
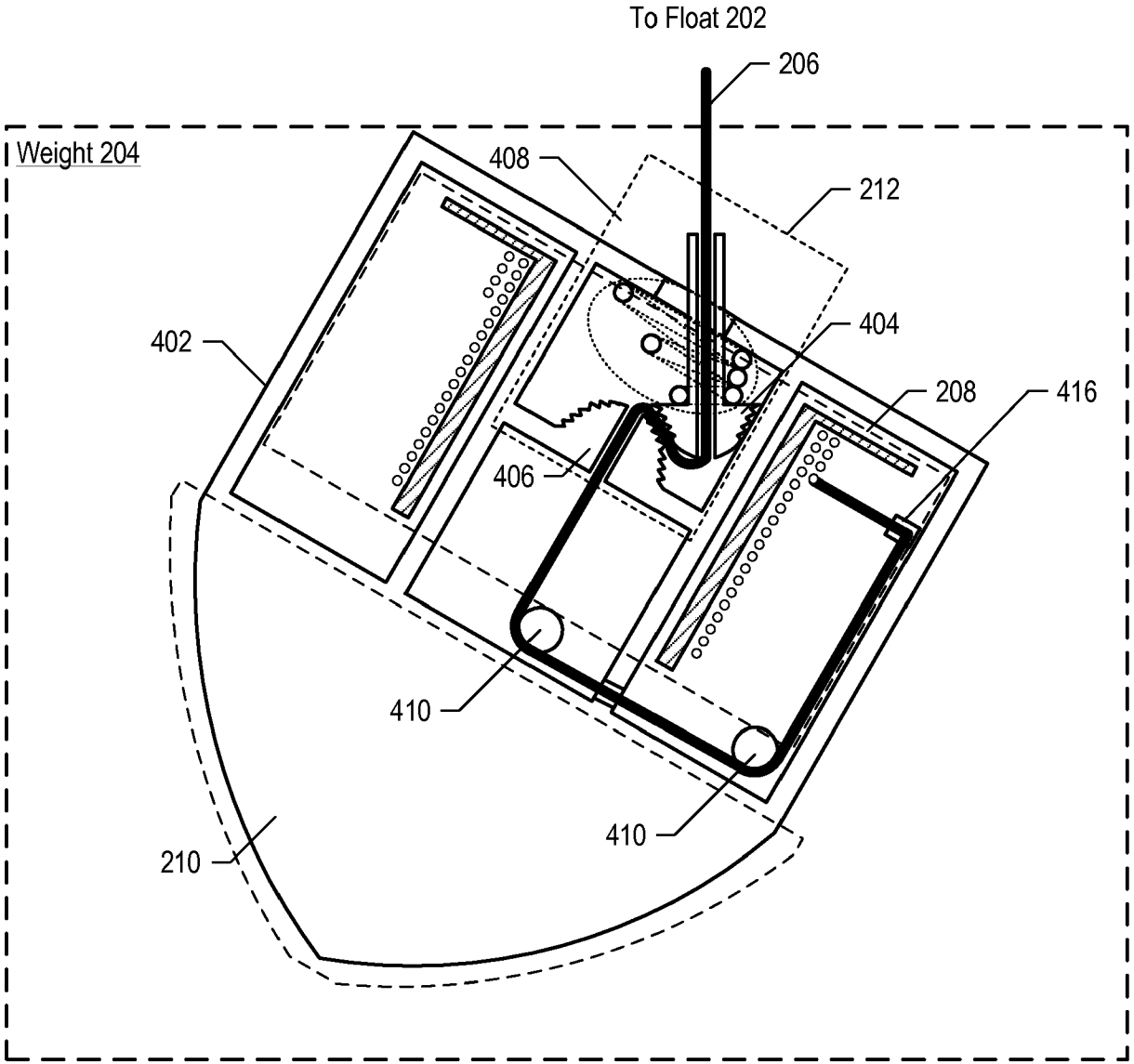
FIG. 5 depicts details of weight 204, after deployment, in accordance with the illustrative embodiment of the invention.

FIG. 5 depicts details of weight 204, after deployment, in accordance with the illustrative embodiment of the invention. Latch 212 is depicted as having been actuated and is now in its second mechanically-stable position.

Latch 212 is passively actuated by the generation of a side load in lanyard 206. The side load arises due to a rotation of weight 204 as it hits the ocean bottom. Upon reaching the ocean bottom, the axial tension on lanyard 206 decreases and rotator 210 rotates weight 204. As weight 204 rotates, a laterally-directed force arises on first guide 404. This force causes a misalignment of the protuberances of first guide 404 and second guide 406. As a result, spring 408 is allowed to decompress and drive first guide 404 into a wedged position against second guide 406 and the interior wall of housing 402.

Since lanyard 206 is threaded through both first guide 404 and second guide 406, it becomes clamped between these guides as first guide moves into its latched position. Thus, further payout of lanyard 206 is halted and a positive connection is established between float 202 and weight 204, which now rests on the ocean bottom.

It is to be understood that the above-described embodiments are merely illustrative of the present invention and that many variations of the above-described embodiments can be devised by those skilled in the art without departing from the scope of the invention. For example, in this Specification, numerous specific details are provided in order to provide a thorough description and understanding of the illustrative embodiments of the present invention. Those skilled in the art will recognize, however, that the invention can be practiced without one or more of those details, or with other methods, materials, components, etc.

Furthermore, in some instances, well-known structures, materials, or operations are not shown or described in detail to avoid obscuring aspects of the illustrative embodiments. It is understood that the various embodiments shown in the Figures are illustrative, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily all embodiments. Consequently, the appearances of the phrase "in one embodiment," "in an embodiment," or "in some embodiments" in various places throughout the Specification are not necessarily all referring to the same embodiment. Furthermore, the particular features, structures, materials, or characteristics can be combined in any suitable manner in one or more embodiments. It is therefore intended that such variations be included within the scope of the following claims and their equivalents.

What is claimed is:

1. An apparatus comprising:

a weight that deploys to a submerged surface in a body of water, wherein the weight is dimensioned and arranged to physically couple with a lanyard, and wherein the weight comprises a guide that guides the lanyard during deployment of the weight;

the guide, wherein the guide comprises a latch that clamps the lanyard when the weight is fully-deployed, and wherein the latch is passively actuated when the weight is fully-deployed; and a rotator that is dimensioned and arranged to induce a rotation of the weight when the rotator contacts a surface;

wherein the latch is dimensioned and arranged to actuate based on a bending moment in the lanyard, and wherein the bending moment is induced by the rotation.

2. The apparatus of claim 1 wherein the latch is passively actuated when an axial tension in the lanyard is reduced.

3. The apparatus of claim 1 further comprising a spring for actuating the latch.

4. The apparatus of claim 1 wherein the weight comprises a lanyard spool, wherein the lanyard spool is rotatable with respect to the weight.

5. The apparatus of claim 1 further comprising the lanyard.

6. An apparatus comprising a weight that deploys to a submerged surface in a body of water, wherein the weight is dimensioned and arranged to physically couple with a lanyard, and wherein the weight comprises:

a lanyard spool; and a latch that captures the lanyard when the latch is actuated, wherein the latch is passively actuated by the generation of a bending moment in the lanyard;

wherein the weight is dimensioned and arranged to rotate with a first rotation upon its contact with a surface, and wherein the bending moment is generated by the first rotation.

7. The apparatus of claim 6 wherein actuation of the latch is substantially irreversible.

8. The apparatus of claim 6 wherein the latch comprises:

a first guide for guiding the lanyard; and a second guide for guiding the lanyard;

wherein the first guide and the second guide are coaxially-aligned and allow passage of the lanyard prior to actuation of the latch, and wherein the first guide and the second guide not coaxially-aligned and cooperatively clamp the lanyard after actuation of the latch.

9. The apparatus of claim 6 wherein the latch is mechanically bistable, and wherein the latch has a first position in which the latch allows passage of the lanyard, and wherein the latch has a second position in which the latch clamps the lanyard.

10. The apparatus of claim 6 wherein the weight substantially contains the lanyard spool, and wherein the lanyard spool is rotatable with respect to the weight.

11. An apparatus comprising:

a weight that deploys to a submerged surface in a body of water, wherein the weight is dimensioned and arranged to physically couple with a lanyard, and wherein the weight comprises a latch; and the latch, wherein the latch is passively actuated, and wherein the latch comprises;

(1) a first guide for guiding a lanyard;

(2) a second guide for guiding the lanyard, wherein the second guide is mechanically bi-stable, and wherein the second guide has a first position in which the latch allows passage of the lanyard, and further wherein the second guide has a second position in which the latch clamps the lanyard to disallow passage of the lanyard;

wherein the weight comprises a physical adaptation for causing a rotation of the weight upon its contact with a surface, and wherein the actuation of the latch is induced by the rotation.

12. The apparatus of claim 11 further comprising a lanyard spool, wherein the lanyard spool comprises a physical adaptation for providing the lanyard to the first guide and the second guide.

13. The apparatus of claim 12 wherein the lanyard spool is rotatable with respect to the weight.

14. The apparatus of claim 11 wherein the first guide is substantially immovable with respect to the weight, and wherein the lanyard is clamped between the first guide and the second guide when the second guide is in the second position.

15. The apparatus of claim 14 wherein actuation of the latch is substantially irreversible.

* * * * *